United States Patent [19]

Kelley, Sr.

[11] Patent Number: 5,040,723

[45] Date of Patent: Aug. 20, 1991

[54] MAILBOX SIGNALLING DEVICE

[76] Inventor: Kalon L. Kelley, Sr., 520 E. Montecito St., Santa Barbara, Calif. 93103-3291

[21] Appl. No.: 441,636

[22] Filed: Nov. 27, 1989

Related U.S. Application Data

[63] Continuation-in-part of Ser. No. 350,219, May 11, 1989, abandoned.

[51] Int. Cl.[5] ..... B65D 91/00

[52] U.S. Cl. ..... 232/35; 232/34

[58] Field of Search ..... 232/17, 34, 35

[56] References Cited

U.S. PATENT DOCUMENTS

| | | | |
|---|---|---|---|
| 2,356,020 | 8/1944 | Westerfield | 232/35 |
| 2,551,915 | 5/1951 | Turner | 232/34 |
| 3,081,024 | 3/1963 | Sichler | 232/34 |
| 4,738,392 | 4/1988 | Kovacs | 232/35 |
| 4,778,103 | 10/1988 | Nelsen | 232/35 |

*Primary Examiner*—Robert W. Gibson, Jr.

*Attorney, Agent, or Firm*—Robert M. Sperry

[57] ABSTRACT

Improved mailbox signalling means comprising a mailbox having a door, a drive arm mounted for movement with the door upon opening and closing of the door, a toothed member mounted for rotation upon engagement by the drive arm, and indicia positionable upon rotation of the toothed wheel to indicate that the wheel has been rotated.

6 Claims, 2 Drawing Sheets

MAILBOX SIGNALLING DEVICE

RELATED APPLICATIONS

This application is a Continuation-In-Part of my copending application, Ser. No. 350,219, filed May 11, 1989 and now abandoned.

BACKGROUND

1. Field of Invention

This invention relates to signalling devices and is particularly directed to means for indication the presence or absence of mail in the mailbox.

2. Prior Art

In general, mailboxes are formed of opaque material. Therefore, it is necessary to make a trip to the box and open it in order to determine whether or not there is mail in the box. While most mailboxes have a manually movable flag which can be erected to indicate that there is mail within the box for the mailman to pick up, this has little informational value for a resident as to when the mail has been delivered; furthermore, depending upon two different people to perform two distinct manual operations to convey information will inevitably be nondependable in a way avoided by a fully automatic operation. Moreover, mail deliveries are not made at precise times. Thus, mail at some addresses may be delivered anytime between 9 A.M. and 4 P.M. Hence, persons expecting important mail are often required to make frequent trips to the mailbox to determine whether the mail has yet come. If the mailbox is located a substantial distance from the house or in inclement weather, the necessity for making such a trip can be annoying and, if repeated trips are needed, the annOyance Can become greatly aggravated. FurthermOre, where the mail may be picked up by more than one person, there is no way for anyone to know whether no mail has been delivered or whether someone else has picked it up. Numerous signalling devices have been proposed heretofore to overcome these problems. However, many of the prior art devices have been complex to operate and expensive to produce. Furthermore, many of the prior art signalling devices have involved electronic mechanisms which do not survive well when exposed to weather and, hence, have been subject to repeated failures. Thus, none of the prior art mailbox signalling devices have been entirely satisfactory.

BRIEF SUMMARY AND OBJECTS OF INVENTION

These disadvantages of the prior art are overcome with the present invention and improved mailbox signalling means is provided which is simple to operate and inexpensive to produce and which requires no electrical mechanisms, yet provide a positive and reliable indication of the presence or absence of mail in the mailbox.

The advantages of the present invention are preferably attained by providing improved mailbox signalling means comprising a mailbox having a door, a drive arm mounted for movement with the door upon opening and closing of the door, a toothed member mounted for rotation upon engagement by the drive arm, and indicia positionable upon rotation of the toothed wheel to indicate that the wheel has been rotated.

Accordingly, it is an object of the present invention to provide improved mailbox signalling means.

Another object of the present invention is to provide improved mailbox signalling means which is simple to operate and inexpensive to produce.

An additional object of the present invention is to provide improved mailbox signalling means which provides a positive and reliable indication of the presence or absence of mail in the mailbox.

A specific object of the present invention is to provide improved mailbox signalling means comprising a mailbox having a door, a drive arm mounted for movement with the door upon opening and closing of the door, a toothed member mounted for rotation upon engagement by the drive arm, and indicia positionable upon rotation of the toothed wheel to indicate that the wheel has been rotated.

These and other objects and features of the present invention will be apparent from the following detailed description, taken with reference to the figures of the accompanying drawings.

DETAILED DESCRIPTION OF THE INVENTION

Figures 1, 2:
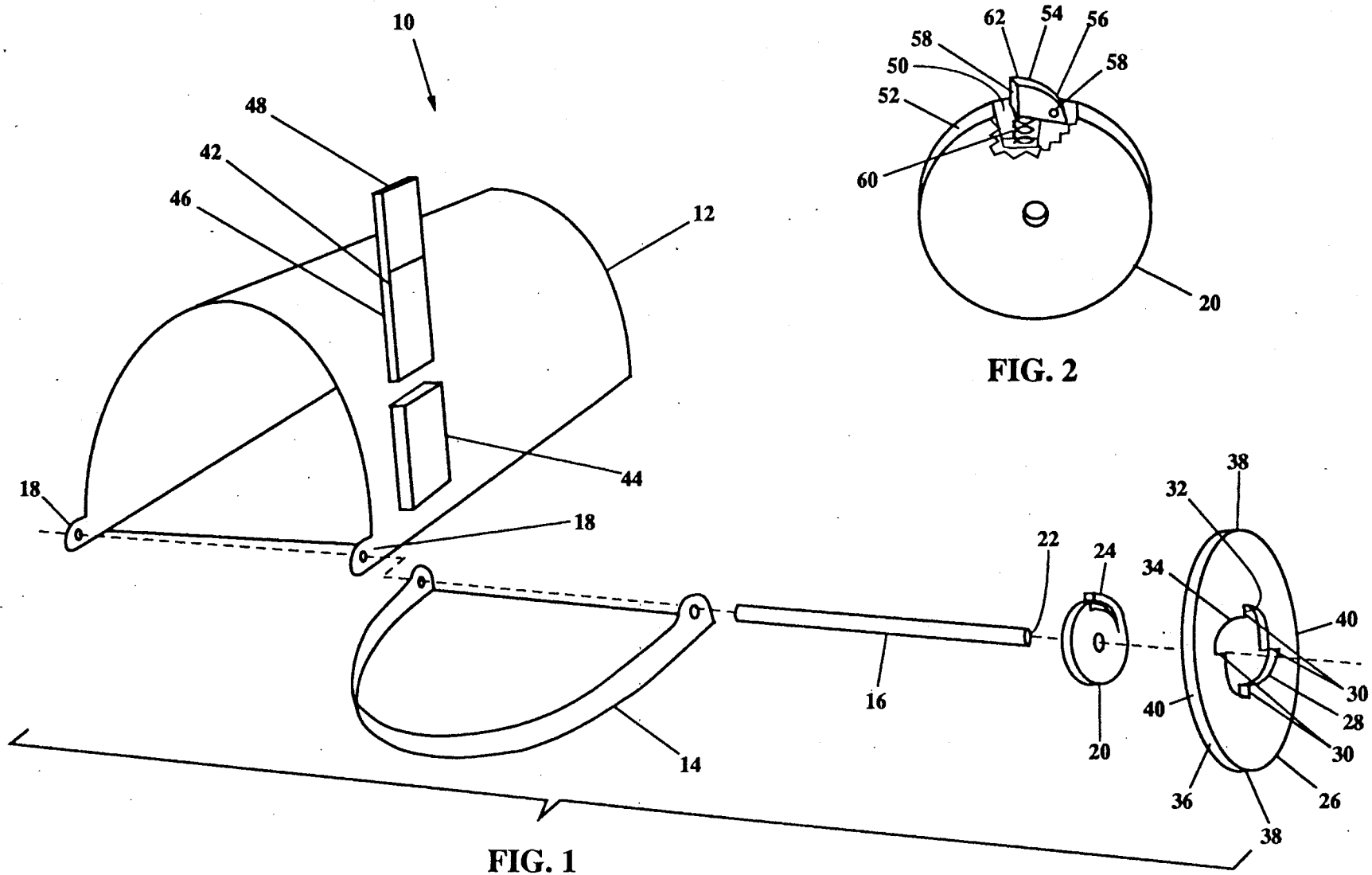
FIG. 1 is an exploded view of a mailbox embodying the siqnalling means of the present invention; (and)
FIG. 2 is an enlarged view of the pawl means of the mailbox signalling means of FIG. 1.

In that form of the present invention chosen for purposes of illustration in the drawing, FIG. 1 shows a mailbox, indicated generally at 10, comprising a housing 12 for receiving mail and a door 14 which is hingedly secured to the housing 12 by a suitable shaft 16 which projects through flanges 18 of the housing 12 and is secured for rotation with the door 14. A drive wheel 20 is mounted adjacent one end 22 of the shaft 16 and is secured for rotation with the shaft 16. As shown, the drive wheel 20 is generally circular but is formed with a resilient drive member, such as arm 24, which, when depressed, lies within the circumference of the drive wheel 20, but which normally projects outwardly from the periphery of the drive wheel 20 as seen in FIG. 1. An eccentric member 26 is rotatably mounted on the side of the housing 12 and is formed with a central, generally circular opening 28 positioned to receive the drive wheel 20 therein and formed with a plurality of ratchet members 30 projecting inwardly about the periphery of the opening 28 for engagement by the drive member 24 of the drive wheel 20. Each of the ratchet members 30 is located to position the adjacent portion of the eccentric member in an upward positiOn and is formed with a driving face 32 extending radially inward and a camming surface 34 curving gradually inward from the circumference of the opening 28 to the inner end of the ratchet member 30 The outer surface 36 of the eccentric member 26 is generally oval, having elongated end portions 38 and relatively small side portions 40. Finally, a suitable flag member 42 is slidably mounted on the side of the housing 12 within a suitable sleeve 44, and is formed with a stem portion 46 which extends through the sleeve 44 and is urged by gravity into engagement with the outer surface 36 of the eccentric member 26. The flag member 42 also has an indicatOr portion 48, preferably brightly colored or otherwise formed to provide a positive visual indication when it is in the raised position. The sleeve 44 is preferably of a length such that, when the flag member 42 is in its lowered position, the sleeve 44 will completely enclose the flag member 42, but when the flag member 42 is in its raised position, the indicator portion 48 will project above the top of the sleeve 42. Alternatively, the sleeve 42 could be formed to completely enclose the flag member 42 to protect the flag member 42 against exposure to the weather and could be formed with a transparent upper portion to permit viewing of the indicator portion 48 of the flag member 42 when it the flag member 42 is in its raised position.

In use, the eccentric member 26 is initially positioned with the door 14 of the mailbox 10 in its closed position and with the small portion 40 facing upward, thus causing the stem 46 of the flag member 42 to be in its lowered position completely enclosed within sleeve 44. When the mailman opens the door 14 to deliver mail, he rotates the door 14 outwardly and downwardly and, since the shaft 16 is fixedly secured to the door 14, the movement of the door 14 causes 90° counter-clockwise rotation of the shaft 16 and, hence, of drive wheel 20. The rotation of drive wheel 20 causes the drive member 24 to engage the drive face 32 of the adjacent ratchet member 30 and serves to drive the eccentric member through 90° counter-clockwise rOtation which mOves the elongated portion 38 of the eccentric member 26 to the upward position and drives the stem 46 of the flag member 42 upward to its raised position, causing the indicator portion 48 of the flag member 42 to project from the enclosed portion of the sleeve 44 to provide a visual indication that mail has been delivered. When the mail has been placed in the mailbox 10, the mailman closes the door 14 which causes 90° clockwise rotation of the shaft 16 and drive wheel 20. This movement causes the drive member 24 to bear against the camming surface 34 of the ratchet member 30 until it passes the next drive face 32, whereupon the resilience of the drive member 24 urges the drive member outwardly to its driving position. Subsequently, when someone opens the door 14 of the mailbox 10 to remove the mail, the movement of the door will, again, cause a 90° counter-clockwise rotation of shaft 16 and drive wheel 20. Again, the drive arm 24 will engage the drive face 32 of the adjacent ratchet member 30 and will cause a 90° counter-clockwise rotation of the eccentric member 26. This will again position one of the small portions 40 of the eccentric member 26 in the upward position which will allow the stem 46 of the flag member 42 to descend to its lower position wherein the entire flag member 42 is contained within the sleeve 44 and, thereby, providing a visual indication that there is no mail in the mailbox 10. In this manner, raising and lowering of the flag member 42 is accomplished automatically each time the door 14 of the mailbox 10 is opened and provides a reliable indication of whether or not the mail has been delivered and whether or not the delivered mail has been picked up.

FIG. 2 is an alternative form of the drive wheel 20 of the device of FIG. 1. In this form, a suitable recess 50 is formed adjacent the rim 52 of the drive wheel 20 and the resilient arm 24 is replaced by a pawl member 54 which is hingedly secured to the drive wheel 20 adjacent one end 56 thereof, as by pin 58, and is formed with a driving surface 58 on the opposite end of the pawl member 54. Resilient means, such as spring 60 normally urges the pawl member 54 to its extended driving position, as seen in FIG. 2, while engagement of the outer surface 62 of the pawl member 54 with the camming surface 34 of the ratchet members 30 serves to drive the pawl member 54 inwardly against the action of the resilient means 60 during clockwise rotation of the drive wheel 20.

Figure 3:
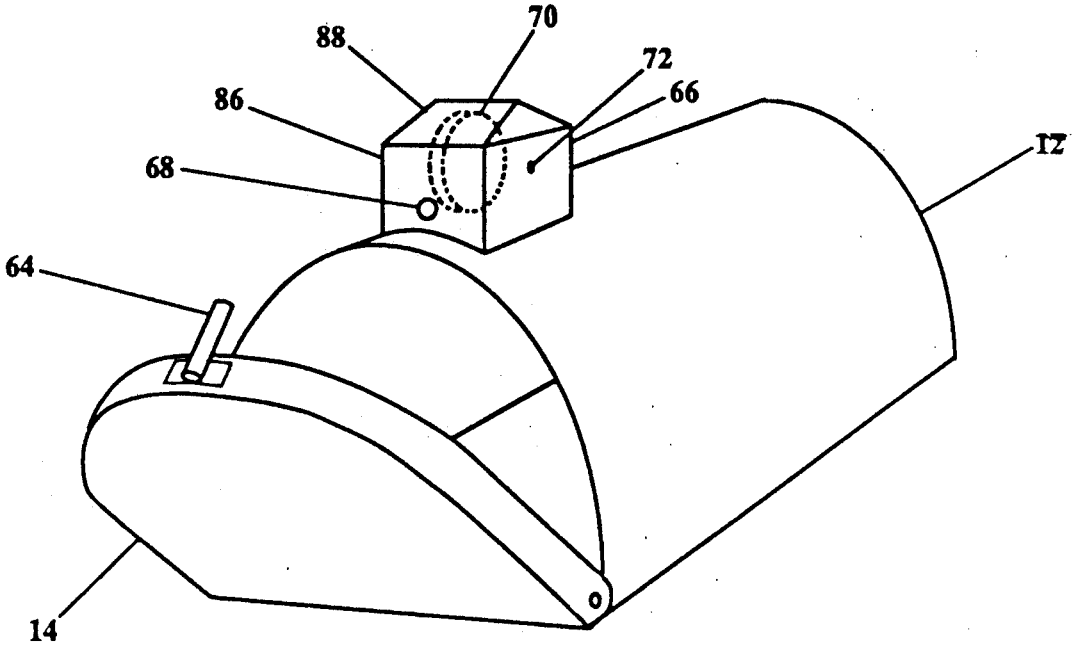
FIG. 3 is a side view of an alternative form of the mailbox signalling means of FIG. 1.
Figure 4:
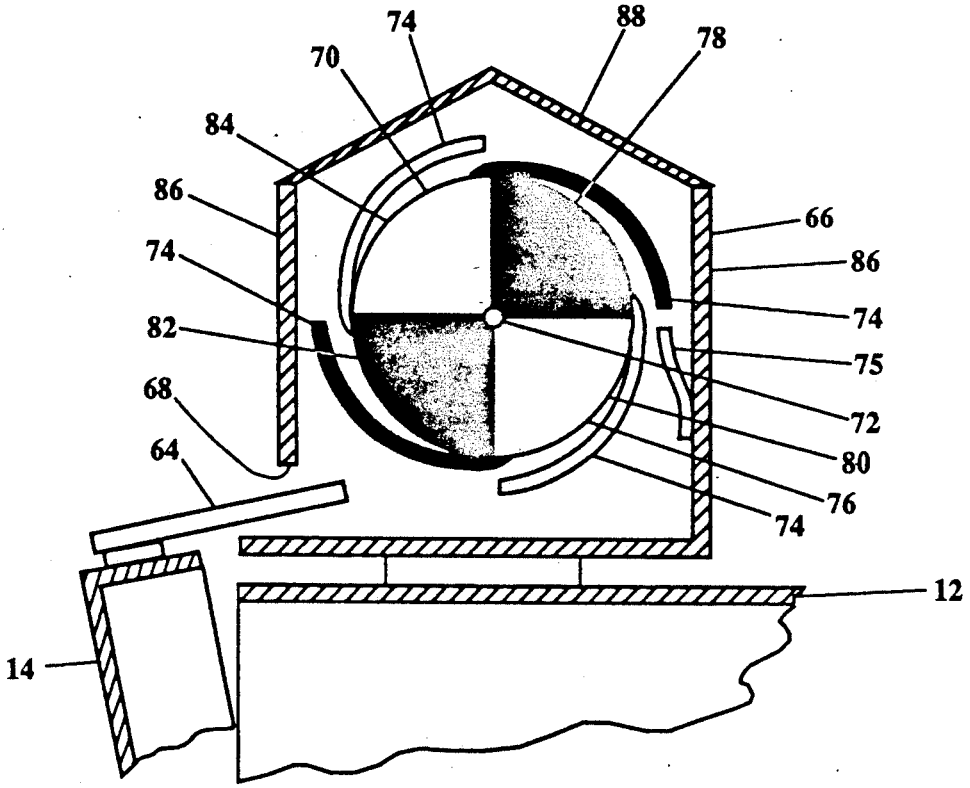
FIG. 4 is a vertical section through the signal box of the mailbox signalling means of FIG. 3.

FIGS. 3 and 4 show a further alternative form of the mailbox signalling device of FIG. 1. In this form of the present invention, a drive arm 64 is mounted on the upper edge of the mailbox door and projects rearwardly of the door 14 a considerable distance. A signalling device 66 is mounted on the top of the mailbox 12 adjacent the front edge thereof and is provided with an opening 68 in the front surface of the signalling device 66 to receive the drive arm 64 when the mailbox door 14 is closed. As best seen in FIG. 4, the signalling device 66 is a generally rectangular box having a toothed wheel 70 rotatably mounted therein, as by shaft 72. The wheel 70 has teeth or arms 74 projecting outwardly and rearwardly from the surface 76 of the wheel 70 in position to be engaged and moved by the drive arm 64, as the drive arm 64 enters the opening 68 when the mailbox door 14 is closed. A suitable pawl 75 is mounted in position to engage the arms 74 to prevent rearward rotation of the wheel 70. As seen in FIG. 4, the wheel 70 is marked with segments 78, 80, 82 and 84 bearing contrasting indicia so that rotation of the wheel 70 from one segment, for example, segment 78, to another segment, such as segment 80, will be clearly noticable. The signalling device 66 is preferably formed with opaque lower walls 86 and has a dome 88 formed of transparent material mounted atop the opaque walls 86.

With this form of the invention, each time that the mailbox door 14 is opened, the drive arm 64 will be removed from the opening 68 of the signalling device 66. This will allow one of the arms 74 to project downward into the path of the drive arm 64. Subsequently, when the mailbox door 14 is closed, the drive arm 64 will be driven into the opening 68 and will engage the end of the arm 74, driving the arm 74 rearwardly and causing the wheel 70 to rotate one segment. Thus, if segment 78 was previously positioned in the transparent dome 88, segment 80 will now be moved into the transparent dome 88 and, because of the contrasting indicia carried by the respective segments 78, 80, 82 and 84, it will be apparent to an observer that the mailbox door 14 has been opened. Thus, each time that the mailbox door 14 is opened and closed, the drive arm 64 will serve to rotate the wheel 70 by one of the segments 78, 80, 82 or 84 to indicate to an observer that the mailbox 12 has been opened.

Obviously numerous other variations and modifications can be made without departing from the spirit of the present invention. Therefore, it should be clearly understood that the forms of the present invention described above and shown in the figures of the accompanying drawings are illustrative only and are not intended to limit the scope of the present invention.

What is claimed is:

1. A mailbox signalling device comprising:

a mailbox having a door, a drive arm mounted for movement with said door upon opening and closing of said door, an enclosed toothed member mounted for rotation upon engagement by said drive arm, and indicia positionable upon rotation of said toothed member to indicate that said wheel has been rotated.

2. The mailbox signalling device of claim 1 wherein:
said drive arm is mounted on the upper edge of the door of said mailbox and projects rearwardly therefrom.

3. The mailbox signalling device of claim 1 wherein:
said toothed member carries indicia to provide a visible indication of the position of said toothed member.

4. A mailbox signalling device comprising:
a mailbox having a door,
a drive arm mounted for movement with said door upon opening and closing of said door
a toothed member mounted for rotation upon direct engagement by said drive arm,
indicia positionable upon rotation of said toothed member to indicate that said member has been rotated,
said drive arm is mounted on the upper edge of the door of said mailbox and projects rearwardly therefrom, and
a housing mounted on top of said mailbox enclosing said toothed member and formed with an opening in the front of said housing for receiving the end of said drive arm.

5. The mailbox signalling device of claim 4 wherein:
said housing is formed with opaque lower walls and a transparent dome mounted atop said opaque walls, and
said toothed member is mounted so as to have at least a portion thereof visible through said transparent dome.

6. A mailbox comprising:
an enclosure for receiving mail having a door to permit mail to be inserted into and removed from said enclosure,
a wheel mounted within a housing mounted on said enclosure and rotatable between a first position providing an indication that there is no mail in said enclosure and a second position indicating that there is mail in said enclosure, and
means movable with said door and directly engageable with said wheel for rotating said wheel from one of said positions to the next.

* * * * *